United States Patent [19]

Ibrahim

[11] 4,315,414

[45] Feb. 16, 1982

[54] AUTOMATIC CLEANING OF REFRIGERATED CASE INTERIOR SURFACES

[75] Inventor: Fayez F. Ibrahim, Niles, Mich.

[73] Assignee: Tyler Refrigeration Corporation, Niles, Mich.

[21] Appl. No.: 146,430

[22] Filed: May 5, 1980

[51] Int. Cl.[3] ..... F25B 19/00; F28G 9/00

[52] U.S. Cl. ..... 62/231; 62/126; 62/303

[58] Field of Search ..... 62/303, 231, 249, 282, 62/256, 126

[56] References Cited

U.S. PATENT DOCUMENTS

| | | | |
|---|---|---|---|
| 2,748,574 | 6/1956 | Gaston | 62/282 X |
| 3,320,964 | 5/1967 | Tripp | 62/303 X |
| 3,888,091 | 6/1975 | Butts | 62/256 |

*Primary Examiner*—William E. Wayner
*Assistant Examiner*—Harry B. Tanner
*Attorney, Agent, or Firm*—LeBlanc, Nolan, Shur & Nies

[57] ABSTRACT

The interior walls of a refrigerated space below a product support shelf in a refrigerated case are automatically washed and cleaned at intervals.

7 Claims, 3 Drawing Figures

AUTOMATIC CLEANING OF REFRIGERATED CASE INTERIOR SURFACES

This invention relates to the cleaning of interior surfaces of refrigerated cases and is particularly conerned with an automatic system for ensuring such cleaning at proper intervals.

Refrigerated cases of the type with which the invention is concerned are for example widely used in supermarkets and the like wherein vegetables, meat and other products benefitting from cooling are placed on shelves or like platforms overlying a space wherein refrigerated air is circulated. The problem giving rise to the invention is the need for at least periodically cleaning the interior surfaces of the case in that space, to remove food fragments, liquids such as blood, stray water and the like that may pass below the shelf and collect on those surfaces. Spray systems for cleaning interior surfaces in such cases are known as shown in Tripp U.S. Pat. No. 3,320,964.

This is essentially a sanitary problem and prior to the invention it has mainly been carried out by workers who manually operate devices to spray cleanse the surfaces at hopefully regular intervals. One difficulty with this is that workers often delay or forget to clean at the proper time, thereby often creating undesirable aesthetic or even health conditions.

The invention provides a solution to the problem by carrying out periodic automatic cleansing of the interior case surfaces under time control, and such is a major object of the invention.

The invention in its preferred embodiment is applicable to a refrigerated case having a cooling system, a cleansing system for washing interior case surfaces and a drainage system for removing the cleansing liquid, and it has for a particular object a novel electrical control system that maintains the cleansing and drainage system inactive while the cooling system is active, and after a predetermined period operates automatically to render the cooling system inactive while activating the cleansing and drainage system until the case walls are clean.

A further and more specific object of the invention is to provide in the foregoing a bypass whereby the drainage system may be activated should liquid accumulate above a certain level in the space below the product support shelf or platform, either by a float switch or manually.

A further object of the invention is to provide a bypass for the electrical control circuit whereby the cooling system may be automatically disabled and a signal energized should the water level in the space below the product support shelf rise above a predetermined level, which level is usually higher than the level at which a float switch in circuit with the drainage system becomes operative.

Further novel features and other objects of this invention will become apparent from the following detailed description, discussion and the appended claims taken in conjunction with the accompanying drawings.

PREFERRED EMBODIMENTS

Figure 1:
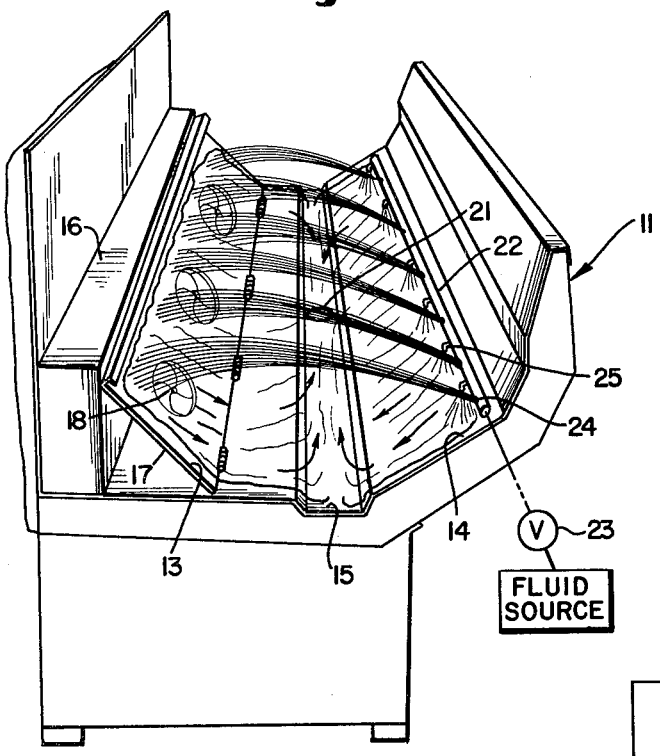
FIG. 1 is a generally perspective view showing a refrigerated case incorporating a preferred embodiment of the invention.

This invention is disclosed as incorporated in a refrigerated case 11 of the type wherein produce and meat for example are displayed on a more or less open shelf 12 for direct selection by the customer in a retail market.

Below the shelf the case is trough-like and has longitudinally extending oppositely downwardly and oppositely inclined interior smooth surfaces 13 and 14 sloping to a central depressed continuous longitudinal gutter 15 which represents the lowest upwardly facing surface region within the case. Surfaces 13 and 14 and the surface of gutter 15 are smooth and hard, as of baked enamel, so that they have no undesirable pockets or crevesses.

Below the shelf the space within the case contains conventional refrigerant coils in a bank indicated at 16, and the surface 13 is on an inclined bottom hinged wall 17 that is apertured to mount a series of motor driven fans 18 which are adapted to continuously circulate air cooled by the coils within the space below shelf 12. Except for shelf 12 the case walls shown are heavily insulated to prevent heat exchange. Shelf 12 allows sufficient heat exchange to preserve the products on it.

A motor driven disposal unit 19 is mounted below the refrigerated space of the case with its inlet coupled into an opening 21 in the bottom of gutter 15. The disposal unit is suitably connected to controllably discharge drained liquid into a waste receiving conduit (not shown).

A longitudinal spray conduit 22 is mounted to extend along the upper part of surface 14 below the shelf 12, substantially parallel to gutter 15. As shown conduit 22 is connected through a control valve 23 to a suitable source of water under pressure, such as the conventional water supply main system.

A multiplicity of directional spray nozzles 24, 25 and 26 are spaced along conduits 22. As shown nozzles 24 direct liquid toward the surface 13, and nozzles 25 and 26 direct liquid downwards at surface 14. Any desired series and spacing of nozzles may be used, for directing water at mains pressure onto the surfaces 13 and 14. The water draining off surfaces 13 and 14 will drain down to gutter 15 which is either level or slightly sloping from both ends toward opening 21.

The purpose of spraying surfaces 13 and 14 is to remove and flush away food fragments and juices, debris and other material that may escape through or around the edges of shelf 12, and wash and maintain those surfaces clean and sanitary. If desired a detergent may be introduced into the water, as by the arrangement disclosed in said U.S. Pat. No. 3,320,964. Operation of the disposal will promote faster flow of the drainage out of gutter 15.

The invention includes as an important phase the automatic control of the flushing operation, for example periodically. This prevents excess build-up of undesirable material in the space below shelf 12 and eliminates the need for an operator to remember and perform the operation.

Figure 3:
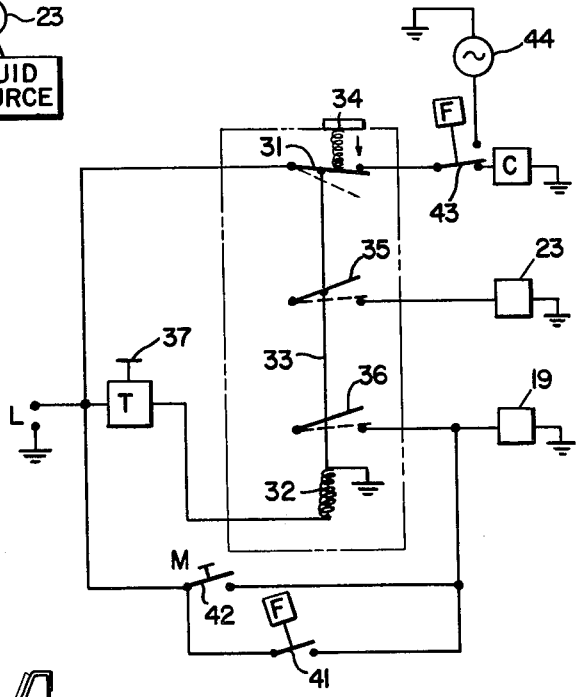
FIG. 3 is a schematic view of that part of the electrical control circuit pertinent to various phases of the invention.
Figure 2:
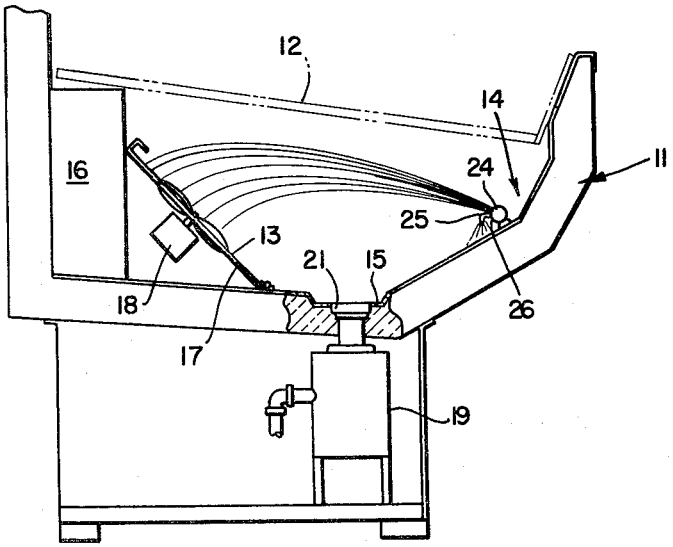
FIG. 2 is an end view partly in section further illustrating the invention in the case of FIG. 1.

A schematic circuit for such automatic control is shown in FIG. 3, this circuit representing only that part of the electric system for the case as is needed to explain the automatic flushing sequence of the invention.

One side of the line is connected to the terminal of a normally closed switch 31 in the actuation circuit of a conventional compressor C (otherwise not shown) operatively associated with the refrigerant coils 16. That side of the line is also connected into a timer T, and one output of the timer leads to a coil 32 at the lower end of an armature 33 which is biased by a tension spring 34 to move switch 31 to the closed condition shown in full lines.

Armature 33 is also connected to the normally open switch 35 in circuit with the solenoid operator of water supply control valve 23, and to the normally open switch 36 in circuit with the disposal 19. The outlet line from the timer is connected to terminals of switches 35 and 36.

The timer is automatically controlled, or may be selectively activated by a manual control 37. It is set to establish periodic flushing periods, by periodically energizing coil 32, whereby simultaneously switch 31 is opened and switches 35 and 36 are closed. The timer maintains this condition for a predetermined interval sufficient to spray-flush surfaces 13 and 14 and then open the circuit to coil 32. The spring 34 now pulls the armature upwardly thereby closing switch 31 for reactivating the compressor circuit, opening switch 35 for shutting off water supply to spray conduit 22 and opening switch 36 for stopping the disposal unit. It will be appreciated that as far as this portion of the compressor control circuit is concerned the circuit to the compressor is closed except when coil 32 is energized. This action may be repeated cyclically as desired under control of the timer.

For some purposes it may be desirable to bypass the automatic control of the disposal unit. To this end the line is connected by a bypass circuit to disposal unit 19 that includes a normally open float controlled switch 41 in parallel with a normally open manual switch 42. The float control switch 41 may be located within the lower part of the space below shelf 12, for activating the disposal to start exhausting water from the space when the water in the space reaches a predetermined level. Switch 41 may be of the type that automatically opens after a predetermined running period. This automatically prevents flooding as during defrosting. The manual switch 42 may be closed to operate the disposal unit at any time.

A further emergency control includes a normally closed float switch 43 in the compressor circuit. This switch is usually set to open whenever the water level in the space below shelf 12 exceeds the water level sensed by float switch 41 and when open it disables the compressor and closes a circuit to an alarm lamp or audible signal 44 which may be located in the store manager's office or at the front of the case 11 as desired.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A refrigerated display case comprising a refrigerant circulation system, a space wherein air cooled by the refrigerant system is circulated, a heat exchange shelf or platform overlying said space on which articles for display are placed, a spray system for cleansing the interior walls of said space and including a passage containing a valve connecting said spray system with a source of cleaning liquid, and a drainage system for said space opening into the lower portion of said space characterized by control means operably connected to said refrigerant system, said spray system and said drainage system, and means for automatically actuating said control means between a normal condition wherein said refrigerant system is active and said spray system and drainage system are inactive, and a space cleaning condition wherein said refrigerant system is inactive, said spray system is activated to discharge cleansing liquid on the space walls and said drainage system is activated for removal of said liquid from the space, said drainage system including a motorized disposal unit.

2. A refrigerated display case comprising a refrigerant circulation system, a space wherein air cooled by the refrigerant system is circulated, a heat exchange shelf or platform overlying said space on which articles for display are placed, a spray system for cleansing the interior walls of said space and including a passage containing a valve connecting said spray system with a source of cleaning liquid, and a drainage system for said space opening into the lower portion of said space characterized control means operably connected to said refrigerant system, said spray system and said drainage system, and means for automatically actuating said control means between a normal condition wherein a refrigerant system is active and said spray system and drainage system are inactive, and a space cleaning condition wherein said refrigerant system is inactive, said spray system is activated to discharge cleansing liquid on the space walls and said drainage system is activated for removal of said liquid from the space, said refrigerant system containing a compressor driven by an electrical motor, said drainage system containing an electrical motor for driving a disposal unit and valve having an operating solenoid, characterized by said control means comprising switching means in the circuit of said motors and said solenoid and time controlled means for actuating said switching means.

3. The refrigerated case defined in claim 2, including a common operator for said switching means, and said time controlled means being connected to a solenoid actuator for said common operator.

4. The refrigerated case defined in claim 2, wherein said control means comprises a by-pass circuit portion whereby the disposal unit may be selectively operated independently of said time controlled means.

5. The refrigerated case defined in claim 4, wherein said by-pass circuit contains a normally open float control switch disposed in said space adapted to close when liquid in the space reaches a predetermined level.

6. The refrigerated case defined in claim 4, wherein said control means comprises a by-pass circuit portion to the compressor motor, said by-pass circuit portion containing a normally closed float operated switch that opens when liquid in the space rises beyond a predetermined level to inactivate the compressor motor.

7. The refrigerated case defined in claim 6, including a visual or audible signal device in said by-pass circuit portion to the compressor motor.

* * * * *